US010961821B1

(12) United States Patent
Benson

(10) Patent No.: US 10,961,821 B1
(45) Date of Patent: Mar. 30, 2021

(54) BALL ACTUATED SLEEVE WITH CLOSING FEATURE

(71) Applicant: Halliburton Energy Services, Inc., Houston, TX (US)

(72) Inventor: Cole Alexander Benson, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/569,395

(22) Filed: Sep. 12, 2019

(51) Int. Cl.

| | |
|---|---|
| ***E21B 34/10*** | (2006.01) |
| ***E21B 34/06*** | (2006.01) |
| ***E21B 43/267*** | (2006.01) |
| ***E21B 43/14*** | (2006.01) |

(52) U.S. Cl.
CPC ..... *E21B 34/10* (2013.01); *E21B 34/063* (2013.01); *E21B 43/14* (2013.01); *E21B 43/267* (2013.01); *E21B 2200/06* (2020.05)

(58) Field of Classification Search
CPC ..... E21B 34/10; E21B 34/063; E21B 43/14; E21B 43/26; E21B 43/267; E21B 2200/06
See application file for complete search history.

(56) References Cited

U.S. PATENT DOCUMENTS

| | | | | |
|---|---|---|---|---|
| 9,394,777 | B2 | 7/2016 | Cheng et al. | |
| 9,470,063 | B2 * | 10/2016 | Stewart | E21B 34/102 |
| 9,574,421 | B1 | 2/2017 | Saraya | |
| 9,951,596 | B2 | 4/2018 | Lynk | |
| 10,119,365 | B2 | 11/2018 | Sanchez et al. | |
| 2009/0056934 | A1 * | 3/2009 | Xu | E21B 43/26 166/244.1 |
| 2012/0085548 | A1 | 4/2012 | Fleckenstein et al. | |
| 2016/0108711 | A1 | 4/2016 | Lynk | |
| 2019/0003283 | A1 * | 1/2019 | Atkins | E21B 34/14 |
| 2019/0136666 | A1 * | 5/2019 | Kent | E21B 43/26 |

OTHER PUBLICATIONS

Swain, C., J. Powell, and S. Stadnyk. "Evolving Completion Technologies Mitigate Proppant Flowback." SPE Annual Technical Conference and Exhibition. Society of Petroleum Engineers, 2017.
Salah, Mohamed, Mohamed Gabry, and Mohamed El-Sebaee. "Evaluation of Multistage Fracturing Stimulation Horizontal Well Completion Methods in Western Desert, Egypt." SPE Middle East Oil & Gas Show and Conference. Society of Petroleum Engineers, 2017.
Canadian Office Action dated Dec. 3, 2020, Canadian Patent Application No: 3,056,462.

* cited by examiner

*Primary Examiner* — James G Sayre
(74) *Attorney, Agent, or Firm* — McGuireWoods LLP

(57) ABSTRACT

A method of fracturing a subterranean formation includes establishing a plurality of zones in a wellbore, fracturing and then isolating a first of the zones using a ball-activated sleeve such that proppant flow from the formation into the first zone is reduced, and fracturing and then isolating at least one other of the zones uphole of the first zone.

27 Claims, 8 Drawing Sheets

BALL ACTUATED SLEEVE WITH CLOSING FEATURE

BACKGROUND

The present disclosure relates generally to a method for fracturing a subterranean formation and a ball-activated control apparatus.

Subterranean formations, such as oil or gas formations, are often hydraulically fractured to create cracks and other breaks in the rock or other substrate that contains the formation. Proppants, such as sand or other materials, are injected to hold open the cracks so that oil or gas is more easily produced from the formation. Following fracturing of the formation, injected proppants and frac fluid may flow back into the wellbore. When this occurs, the fractures may shrink and reduce the effective flow path for oil and gas production.

DETAILED DESCRIPTION

Figure 1:
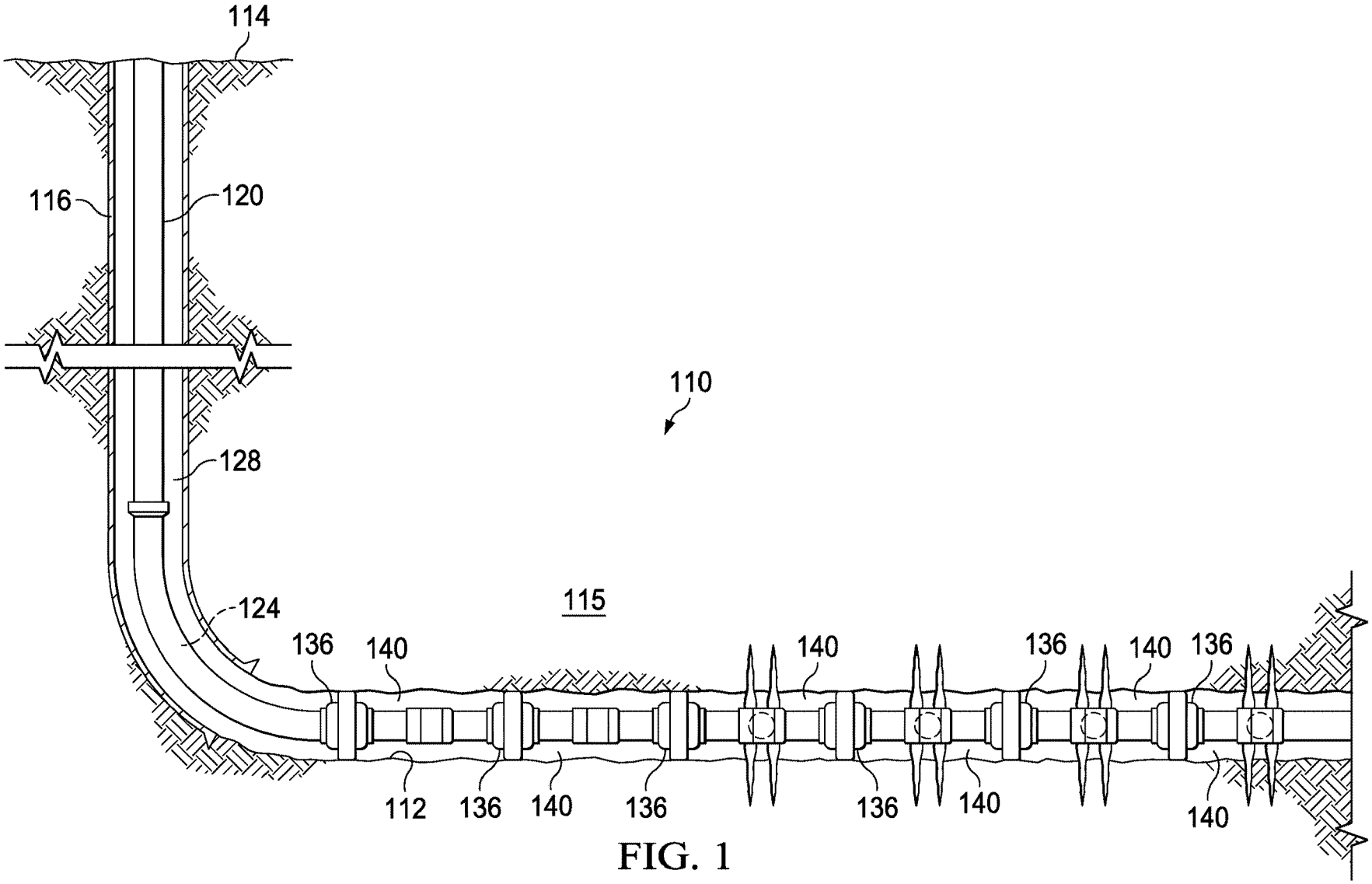
FIG. 1 illustrates a schematic view of a ball-activated fluid control system deployed in a wellbore according to an illustrative embodiment.

In the following detailed description of several illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

The present disclosure relates to a ball-activated fluid control system that is positionable downhole in a wellbore during and after fracturing operations. The well may be divided into multiple zones, and each zone may include one of the ball-activated fluid control systems. A common tubing string may pass through each of the zones, and segments of the tubing string may be fluidly coupled to each of the ball-activated fluid control systems. Packers positioned along the tubing allow an annulus within each zone to be isolated from the annulus in other zones. The ball-activated fluid control system each includes a sleeve that is operable to open or close and thus allow the fluid communication between the annulus within a particular zone and a passage of the tubing string. The configuration of the ball-activated fluid control system is such that the sleeve is movable when ball is dropped in the tubing string and fluid pressure within the tubing string is changed to cause movement of the sleeve. During fracturing operations of a particular zone, the sleeve is positioned to allow frac fluids and proppants within the tubing string to be pushed into the annulus and formation. Following fracturing, the sleeve is closed for an amount of time to prevent proppants and frac fluids from flowing out of the formation.

By leaving the proppants and frac fluids in place for the amount of time, the cracks and fractures are allowed to "heal," or close with the proppant in place. This creates a more effective flow path and lessens the likelihood that proppant will flow from the formation during production.

FIG. 1 illustrates a ball-activated fluid control system 110 in accordance with an illustrative embodiment of the present disclosure. The ball-activated fluid control system 110 is deployed in a wellbore 112 extending from a surface location 114 of the well into a geologic formation 115. In the illustrated embodiment, the wellbore 112 extends from a terrestrial or land-based surface location 114. In other embodiments, the ball-activated fluid control system 110 may be deployed in wellbores extending from offshore or subsea surface locations using offshore platforms, drill ships, semi-submersibles or drilling barges. The wellbore 112 defines an "uphole" direction referring to a portion of wellbore 112 that is closer to the surface location 114 along the path of the wellbore and a "downhole" direction referring to a portion of wellbore 112 that is further from the surface location along the path of the wellbore.

In FIG. 1, the portion of the wellbore 112 in which the ball-activated fluid control system 110 is positioned has a generally horizontal orientation. In other embodiments, the wellbore 112 may include sections with alternative orientations such as vertical, slanted or curved without departing from the scope of the present disclosure. Wellbore 112 optionally includes a casing 116 therein, which extends generally from the surface location 114 to a selected downhole depth. Portions of the wellbore 112 that do not include casing 116 may be described as "open hole."

A tubing string 120 that may be comprised of multiple tubing segments is positioned in the wellbore 112 and extends from the surface location 114 to a portion of the wellbore passing through the geologic formation 115. The tubing string 120 includes a passage 124 that is capable of conveying fluid. An annulus 128 is formed between the tubing string 120 and the wellbore and is further capable of conveying fluid. A plurality of packers 136 are coupled to the tubing string 120 and each is capable of being positioned in a deployed position in which the packer seals against a wall of the wellbore 112, or when the hole is cased, against the casing 116. Many alternative packer types exist, and the packers 136 may be any packer capable of sealing between the tubing string 120 and a wall of the wellbore 112. Examples of packer types that may be used include hydraulic set, mechanical set or swellable packers. When multiple packers 136 are deployed along the tubing string 120, fluidly isolated zones 140 are created between adjacent packers 136. Another zone 140 may be created between the packer 136 positioned furthest downhole and the bottom of the wellbore 112. The annulus 128 of each zone 140 is fluidly isolated from the other zones 140.

Within each zone 140, the ball-activated fluid control system 110 may be deployed to provide fluid control between the annulus 128 and the interior of the tubing string 120. As explained in more detail below, the ball-activated fluid control system 110 is capable of being activated by a ball dropped into the tubing string 120 to open or close ports that allow fluid communication between the annulus 128 and the tubing string 120. Such controls allows the geologic formation 115 to be fractured with "frac" fluids pumped through the tubing string 120 and into the geologic formation. Each zone 140 may then be isolated following fracturing to permit the healing of the fractured geologic formation 115 prior to regular production of oil or gas.

Figure 2:
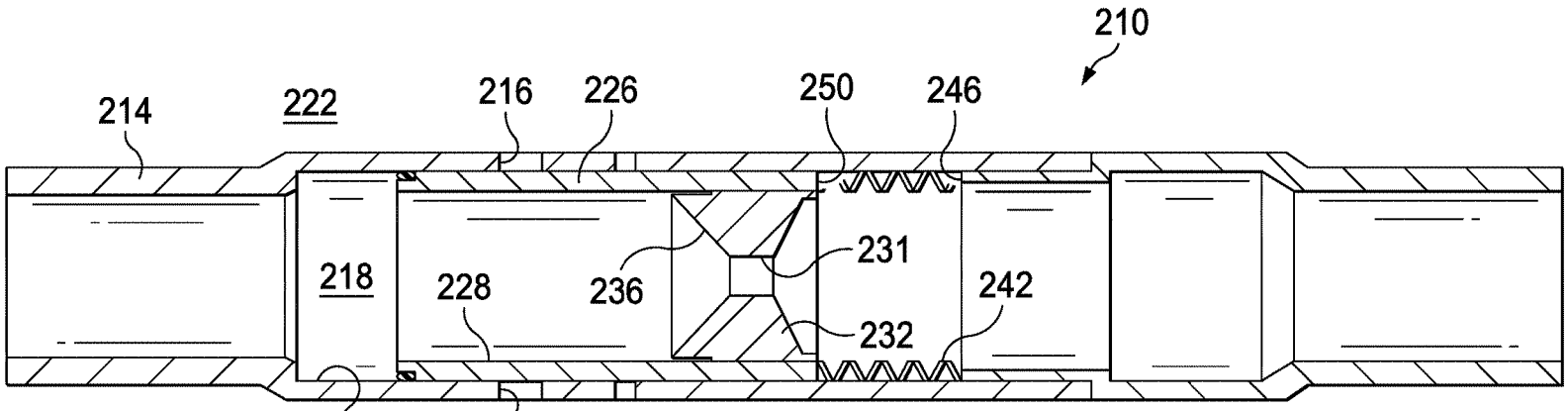
FIG. 2 illustrates a cross-sectional schematic view of a ball-activated fluid control apparatus in a home position according to an illustrative embodiment.
Figure 3:
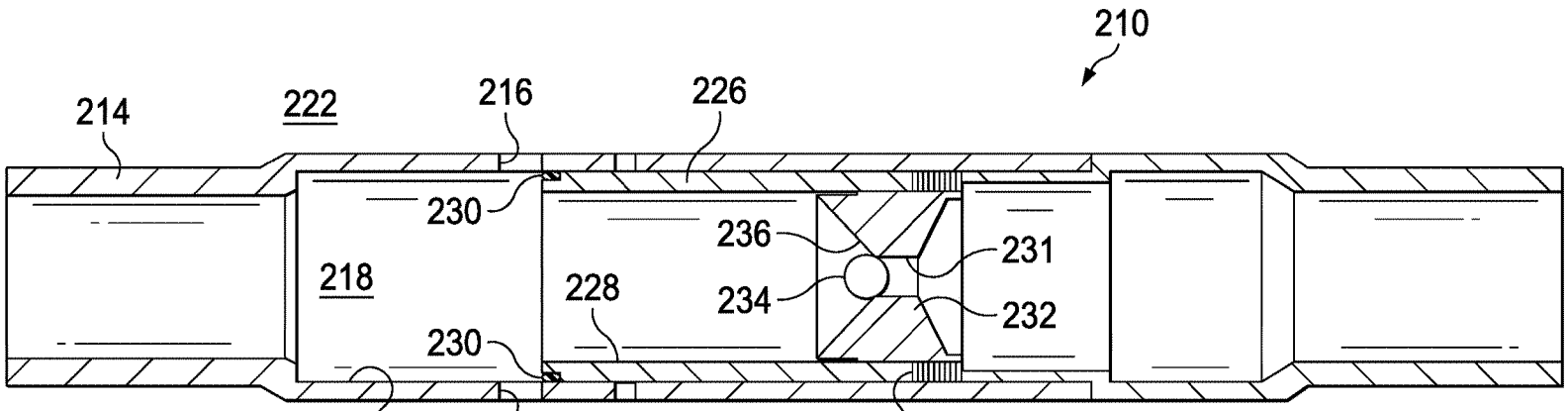
FIG. 3 illustrates a cross-sectional schematic view of the ball-activated fluid control apparatus of FIG. 2 in a first operating position.
Figure 4:
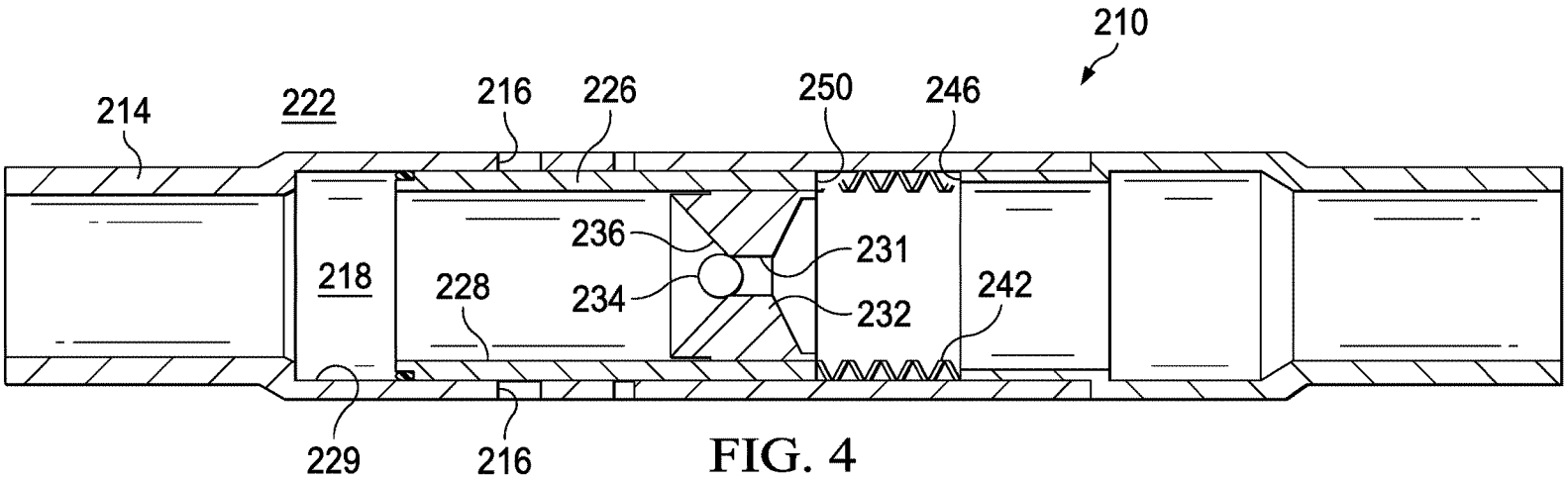
FIG. 4 illustrates a cross-sectional schematic view of the ball-activated fluid control apparatus of FIG. 2 in a second operating position.

Referring to FIGS. 2-4, a cross-sectional view of an embodiment of a ball-activated fluid control system 210 is illustrated. The ball-activated fluid control system 210 includes a body 214 that may be coupled at each end to the tubing string 120 described with reference to FIG. 1. The ball-activated fluid control system 210 is used in the same way as ball-activated fluid control system 110 to isolate well zones following fracturing of the formation adjacent a particular zone.

The body 214 of the ball-activated fluid control system 210 includes a port 216 to provide fluid communication between an interior 218 and an exterior 222 of the body 214. The port 216 may be a circular hole or a non-circular aperture such as a slot. As shown in FIGS. 2-4, two or more ports 216 may be provided to provide increased flow capacity between the interior 218 and exterior 222 when the ports 216 are opened.

The ball-activated fluid control system 210 further includes a sleeve 226 slidingly disposed within the interior 218 of the body 214. The sleeve 226 may include a body 228 and a baffle 232 disposed within the body 228. In some embodiments, the body 214 is tubular and includes a central passage 229 that has a larger diameter than a passage 231 passing through the baffle 232. The baffle 232 may further include a seat 236 upon which a sealing member such as a ball may be landed to block flow through the sleeve 226. The baffle 232 may be an integral part of the sleeve 226, or the baffle 232 may instead be coupled to the body 228 of the sleeve 226 by welding, press fitting, or other attachment means.

The sleeve 226 is positionable within the body 214 between a home position shown in FIG. 2, a first operating position shown in FIG. 3, and a second operating position shown in FIG. 4. In the embodiment illustrated in FIGS. 2-4, the second operating position of the sleeve 226 is the same as the home position. In the home position or the second operating position, the sleeve 226 prevents fluid communication between the interior 218 and exterior 222 through the port 216. The sleeve 226 may physically block the port 216 to prevent such fluid communication. One or more seals 230 may be coupled to either the body 214 or the sleeve 226 such that a sealed engagement occurs between the body 214 and the sleeve 226 when the sleeve 226 is in the home position. The sealed engagement ensures isolation of the port 216 such that fluid communication between the interior 218 and the exterior 222 is prevented. In the first operating position, the sleeve 226 is positioned such that the port 216 is open and fluid communication is capable of occurring between the interior 218 and the exterior 222. In the embodiment illustrated in FIG. 3, the port 216 is opened since the sleeve 226 has traveled further downhole and the sleeve 226 no longer obstructs the port 216. Alternatively, the sleeve 226 could instead have an aperture, hole or other passage (not shown) through a wall of the sleeve 226 that could align with the port 216 when the sleeve 226 is positioned in the first operating position. Again, this first operating position allows fluid communication between the interior 218 and exterior 222 through the port 216.

In some embodiments, the ball-activated fluid control system 210 includes a spring 242 operably associated with the body 214 and the sleeve 226 such that the sleeve 226 is biased to the home position by the spring 242. In the embodiment illustrated in FIGS. 2-4, the spring 242 is positioned between a shoulder 246 of the body 214 and a shoulder 250 of the sleeve 226 such that spring 242 exerts a force upon the shoulders 246, 250 when compressed. The baffle 232 is affixed to the body 228 of the sleeve 226 and does not move independently of the body 228. The spring 242 is compressed as the sleeve 226 moves from the home position to the first operating position. The spring 242 may be sized and configured to ensure that the sleeve 226 does not move from the home position until a threshold amount of force is applied to the baffle 232 or sleeve 226. Such a configuration allows an operator at a surface of the well to control when the sleeve 226 is moved from the home position to the first operating position. The biasing function of the spring 242 allows the sleeve 226 to return to the home position when the force applied to the baffle 232 or sleeve 226 drops below the threshold amount of force.

The ball-activated fluid control system 210 further includes a ball 234 (see FIGS. 3 and 4) configured to engage the sleeve 226. The ball 234 has a diameter larger than the diameter of the passage 231 passing through the baffle 232, and thus the ball 234 is capable of obstructing fluid flow through the passage 231.

In operation, the ball-activated fluid control system 210 is run into the well with the sleeve 226 positioned in the home position. The ball 234 may be dropped into the well by an operator when it is desired to shift the sleeve 226. The ball 234 is capable of traveling with fluid through the tubing string 120 (see FIG. 1) until the ball 234 lands at the baffle 232. Since the diameter of the ball 234 is greater than the diameter of the passage 231, the ball 234 engages the seat 236 of the baffle 232 and blocks fluid flow through the passage 231. The operator is then capable of increasing fluid pressure uphole of the ball 234 to increase the force that is applied to the baffle 232 or sleeve 226. When the fluid uphole of the ball 234 reaches a first pressure, the force of the spring 242 is overcome and the sleeve 226 moves from the home position to the first operating position. When the sleeve 226 is positioned in the first operating position, the port 216 is opened such that fluid communication between the interior 218 and the exterior 222 is allowed. At this time, the geologic formation 115 (FIG. 1) may be fractured with fluids pumped through the tubing string 120 and into the geologic formation 115. After fracturing the formation 115, the sleeve 226 may then be moved to the second operating position to close the port 216. In the embodiment illustrated in FIGS. 2-4, the second operating position may be the home position, and the operator moves the sleeve 226 to this position by decreasing the pressure to a second pressure that is less than the first pressure. When the fluid uphole of the sleeve 226 reaches the second pressure, the force on the baffle 232 is lessened below the force provided by the spring 242. The spring 242 decompresses which moves the sleeve 226 to the second operating position shown in FIG. 4. The geologic formation 115 accessed by the port 216 is then isolated and frac fluids are therefore held within the formation under pressure as the geologic formation 115 heals. Following the desired time for healing of the geologic formation 115, the port 216 may be re-opened by again moving the sleeve 226 or by milling the sleeve 226 to remove it from the body 214. In the open position the port 216 allows the frac fluids to exit the geologic formation 115 and regular production of oil or gas to begin. Preferably, proppants or other materials included with the frac fluid remain in place within the geologic formation 115 to assist in holding open fractures created by the frac process.

Figure 5:
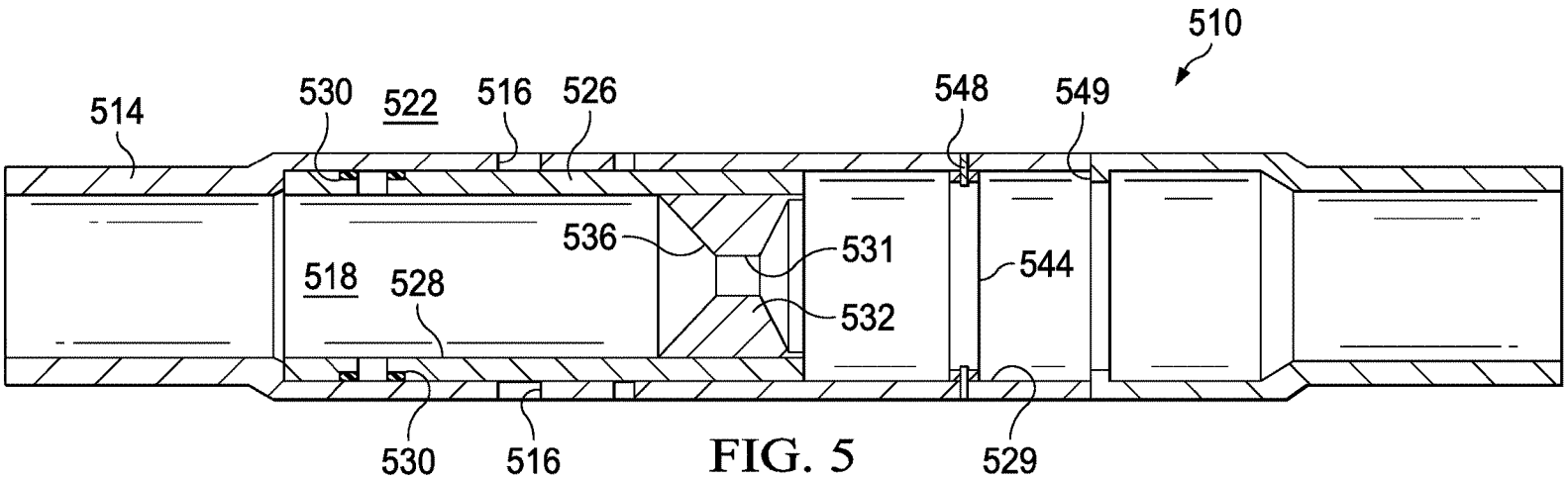
FIG. 5 illustrates a cross-sectional schematic view of a ball-activated fluid control apparatus in a home position according to an illustrative embodiment.
Figure 6:
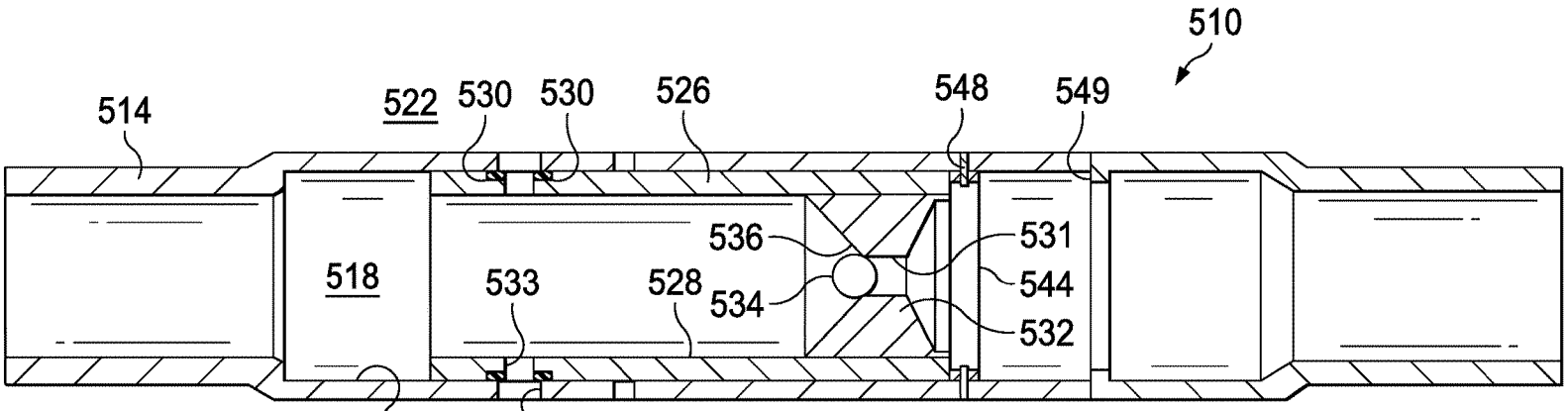
FIG. 6 illustrates a cross-sectional schematic view of the ball-activated fluid control apparatus of FIG. 5 in a first operating position.
Figure 7:
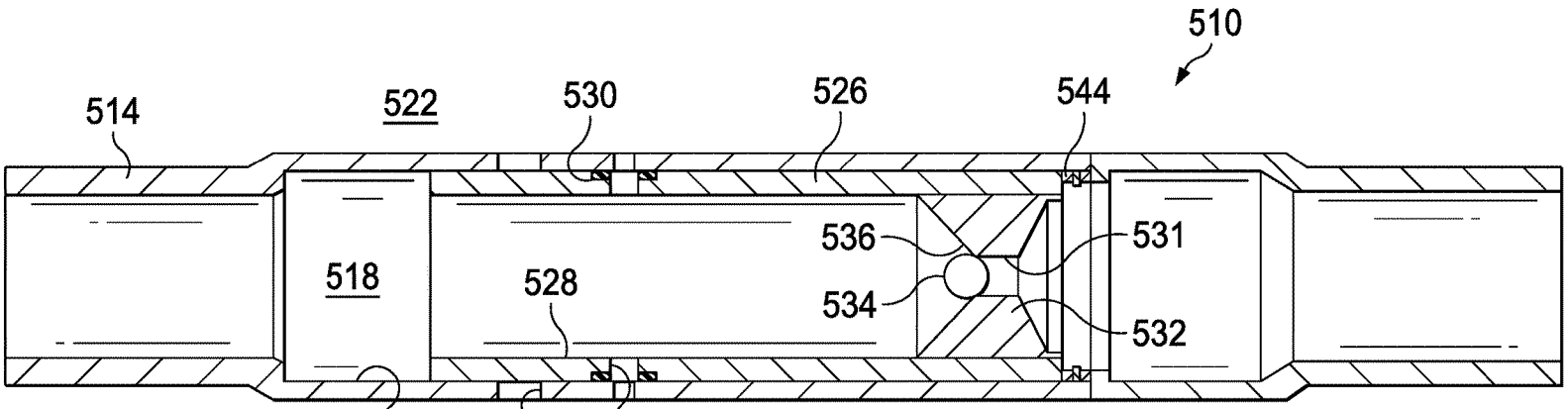
FIG. 7 illustrates a cross-sectional schematic view of the ball-activated fluid control apparatus of FIG. 5 in a second operating position.

Referring to FIGS. 5-7, a cross-sectional view of an embodiment of a ball-activated fluid control system 510 is illustrated. The ball-activated fluid control system 510 includes a body 514 that may be coupled at each end to the tubing string 120 described with reference to FIG. 1. The ball-activated fluid control system 510 is used in the same way as ball-activated fluid control system 110 to isolate well zones following fracturing of the geologic formation 115 adjacent a particular zone.

The body 514 of the ball-activated fluid control system 510 includes a port 516 to provide fluid communication between an interior 518 and an exterior 522 of the body 514. The port 516 may be a circular hole or a non-circular aperture such as a slot. As shown in FIGS. 5-7, two or more ports 516 may be provided to provide increased flow capacity between the interior 518 and exterior 522 when the ports 516 are opened.

The ball-activated fluid control system 510 further includes a sleeve 526 slidingly disposed within the interior 518 of the body 514. The sleeve 526 may include a body 528 and a baffle 532 disposed within the body 528 of the sleeve 526. In some embodiments, the body 514 is tubular and includes a central passage 529 that has a larger diameter than a passage 531 passing through the baffle 532. The baffle 532 may further include a seat 536 upon which a sealing member such as a ball may be landed to block flow through the sleeve 526. The baffle 532 may be an integral part of the sleeve 526, or the baffle 532 may instead be coupled to the body 528 of the sleeve 526 by welding, press fitting, or other attachment means.

The sleeve 526 is positionable within the body 514 between a home position shown in FIG. 5, a first operating position shown in FIG. 6, and a second operating position shown in FIG. 7. In the home position, the sleeve 526 prevents fluid communication between the interior 518 and exterior 522 through the port 516. The sleeve 526 may physically block the port 516 to prevent such fluid communication. One or more seals 530 may be coupled to either the body 514 or the sleeve 526 such that a sealed engagement occurs between the body 514 and the sleeve 526 when the sleeve 526 is in the home position. The sealed engagement ensures isolation of the port 516 such that fluid communication between the interior 518 and the exterior 522 is prevented. In the first operating position, the sleeve 526 is positioned such that the port 516 is open and fluid communication is capable of occurring between the interior 518 and the exterior 522. In the embodiment illustrated in FIG. 6, the port 516 is opened since the sleeve 526 has traveled further downhole and an aperture, hole or other passage 533 through a wall of the sleeve 526 aligns with the port 516 when the sleeve 526 is positioned in the first operating position. Again, this first operating position allows fluid communication between the interior 518 and exterior 522 through the port 516.

Alignment between the port 516 and the aperture 533 when the sleeve 526 is in the first operating position is ensured by a retention system that prevents movement from the first operating position to the second operating position until a sufficient force is applied to the sleeve 526. In the embodiment illustrated in FIGS. 5-7, the retention system may include a ring 544 disposed within the body 514 and secured by at least one shear member such as a shear pin 548. As the sleeve 526 reaches the first operating position shown in FIG. 6, the sleeve engages the ring 544 or other structure held in place by the shear pin 548. In other embodiments, the sleeve 526 may instead engage one or more shear pins 548 directly that act to stop the sleeve 526 in the first operating position.

The shear pins 548 may be sized and configured to ensure that the sleeve 526 does not move from the first operating position toward the second operating position until a threshold amount of force is applied to the baffle 532 or sleeve 526. Such a configuration allows an operator at a surface of the well to control when the sleeve 526 is moved from the first operating position to the second operating position. The application of such a threshold force to the baffle 532 or sleeve 526 is capable of shearing the shear pins 548 thereby allowing the sleeve 526 to move into the second operating position where the port 516 is again blocked by the sleeve 526. A shoulder 549 disposed on the body 514 of the ball-activated fluid control system 510 engages the sleeve 526 to stop the sleeve 526 in the second operating position.

The ball-activated fluid control system 510 further includes a ball 534 (see FIGS. 6 and 7) configured to engage the sleeve 526. The ball 534 has a diameter larger than the diameter of the passage 531 passing through the baffle 532, and thus the ball 534 is capable of obstructing fluid flow through the passage 531.

In operation, the ball-activated fluid control system 510 is run into the well with the sleeve 526 positioned in the home position. The sleeve 526 is held in the home position by shear pins or screws. The ball 534 may be dropped into the well by an operator when it is desired to shift the sleeve 526. The ball 534 is capable of traveling with fluid through the tubing string 120 (FIG. 1) until the ball 534 lands at the baffle 532. Since the diameter of the ball 534 is greater than the diameter of the passage 531, the ball 534 engages the seat 536 of the baffle 532 and blocks fluid flow through the passage 531. The operator is then capable of increasing fluid pressure uphole of the ball 534 to increase the force that is applied to the baffle 532 or sleeve 526. When the fluid uphole of the ball 534 reaches a first pressure, the sleeve 526 is capable of moving into the first operating position. When the sleeve 526 is positioned in the first operating position, the port 516 is opened such that fluid communication between the interior 518 and the exterior 522 is allowed. At this time, the geologic formation 115 may be fractured with fluids pumped through the tubing string 120 and into the geologic formation 115. When the geologic formation 115 has been fractured, the sleeve 526 may then be moved to the second operating position to close the port 516 by increasing the pressure of fluid uphole of the sleeve 526 to a second pressure that is greater than the first pressure. When the fluid uphole of the sleeve 526 reaches the second pressure, the force on the baffle 532 allows the shear pins 548 to break thereby allowing the sleeve 526 to move to the second operating position shown in FIG. 7. The geologic formation 115 accessed by the port 516 is then isolated and frac fluids are held within the formation under pressure as the geologic formation 115 heals. Following the desired time for healing of the geologic formation 115, the port 516 may be re-opened by again moving the sleeve 526 or by milling the sleeve 526 to remove it from the body 514. In the open position the port 516 allows the frac fluids to exit the geologic formation 115 and regular production of oil or gas to begin. Preferably, proppants or other materials included with the frac fluid remain in place within the geologic formation 115 to assist in holding open fractures created by the frac process.

Figure 8:
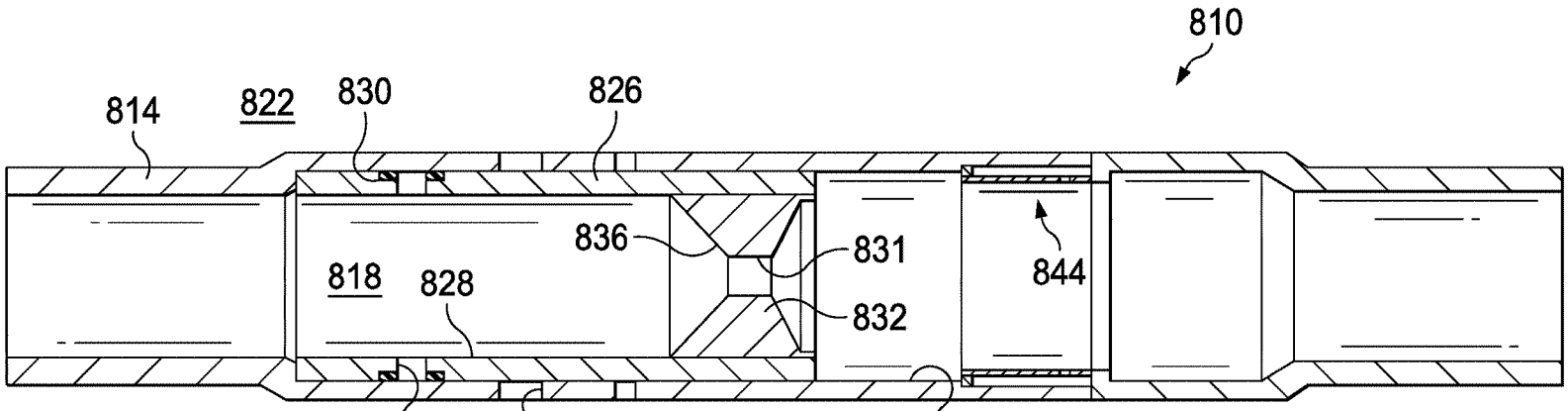
FIG. 8 illustrates a cross-sectional schematic view of a ball-activated fluid control apparatus in a home position according to an illustrative embodiment.
Figure 9A:
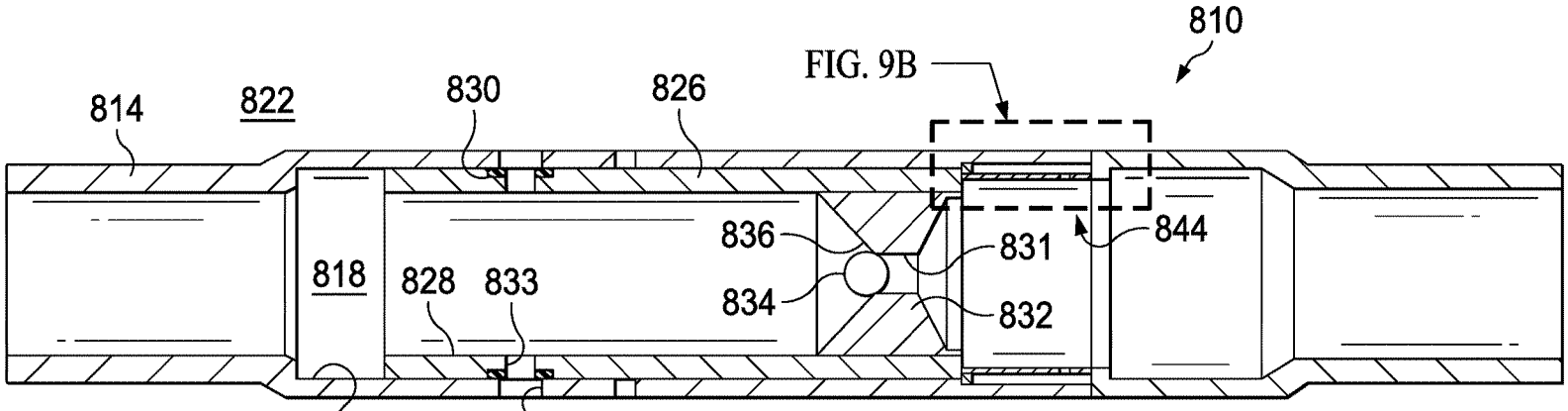
FIGS. 9A and 9B illustrates a cross-sectional schematic view of the ball-activated fluid control apparatus of FIG. 8 in a first operating position.
Figure 9B:
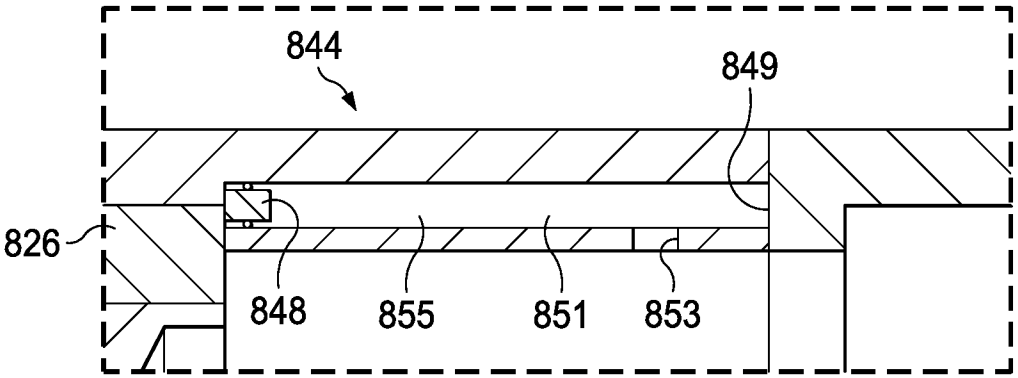
Figure 10:
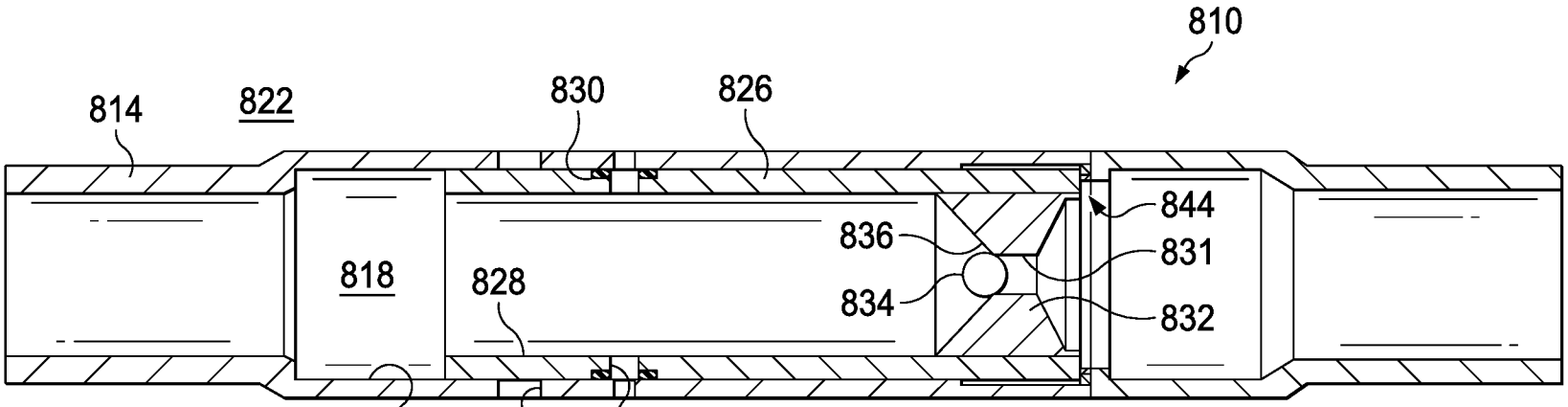
FIG. 10 illustrates a cross-sectional schematic view of the ball-activated fluid control apparatus of FIG. 8 in a second operating position.

Referring to FIGS. 8-10, a cross-sectional view of an embodiment of a ball-activated fluid control system 810 is illustrated. The ball-activated fluid control system 810 includes a body 814 that may be coupled at each end to the tubing string 120 described with reference to FIG. 1. The ball-activated fluid control system 810 is used in the same way as ball-activated fluid control system 110 (FIG. 1) to isolate well zones following fracturing of the geologic formation adjacent a particular zone.

The body 814 of the ball-activated fluid control system 810 includes a port 816 to provide fluid communication between an interior 818 and an exterior 822 of the body 814. The port 816 may be a circular hole or a non-circular aperture such as a slot. As shown in FIGS. 8-10, two or more ports 816 may be provided to provide increased flow capacity between the interior 818 and exterior 822 when the ports 816 are opened.

The ball-activated fluid control system 810 further includes a sleeve 826 slidingly disposed within the interior 818 of the body 814. The sleeve 826 may include a body 828 and a baffle 832 disposed within the body 828 of the sleeve 826. In some embodiments, the body 814 is tubular and includes a central passage 829 that has a larger diameter than a passage 831 passing through the baffle 832. The baffle 832 may further include a seat 836 upon which a sealing member such as a ball may be landed to block flow through the sleeve 826. The baffle 832 may be an integral part of the sleeve 826, or the baffle 832 may instead be coupled to the body 828 of the sleeve 826 by welding, press fitting, or other attachment means.

The sleeve 826 is positionable within the body 814 between a home position shown in FIG. 8, a first operating position shown in FIGS. 9A and 9B, and a second operating position shown in FIG. 10. In the home position, the sleeve 826 prevents fluid communication between the interior 818 and exterior 822 through the port 816. The sleeve 826 may physically block the port 816 to prevent such fluid communication. One or more seals 830 may be coupled to either the body 814 or the sleeve 826 such that a sealed engagement occurs between the body 814 and the sleeve 826 when the sleeve 826 is in the home position. The sealed engagement ensures isolation of the port 816 such that fluid communication between the interior 818 and the exterior 822 is prevented. In the first operating position, the sleeve 826 is positioned such that the port 816 is open and fluid communication is capable of occurring between the interior 818 and the exterior 822. In the embodiment illustrated in FIG. 9A, the port 816 is opened since the sleeve 826 has traveled further downhole, and an aperture, hole or other passage 833 through a wall of the sleeve 826 aligns with the port 816 when the sleeve 826 is positioned in the first operating position. Again, this first operating position allows fluid communication between the interior 818 and exterior 822 through the port 816.

Alignment between the port 816 and the aperture 833 when the sleeve 826 is in the first operating position is ensured by a retention system that prevents movement from the first operating position to the second operating position until a sufficient force is applied to the sleeve 826. In the embodiment illustrated in FIGS. 8-10, the retention system may include a metering system 844 disposed within the body 814. Referring more specifically to FIG. 9B, the metering system 844 may include a piston 848 that moves within a chamber 851 and is capable of engaging the sleeve 826. A metering fluid 855 may be contained within the chamber 851 on a side of the piston 848 opposite the sleeve 826. A metering orifice 853 may be disposed in the chamber 851 to allow metered escape of the metering fluid 855 from the chamber 851 as a force is applied to the piston 848 by the sleeve 826.

As the sleeve 826 reaches the first operating position shown in FIG. 9, the sleeve 826 engages the piston 848. The metering system 844 and metering orifice 853 may be sized and configured to ensure that the sleeve 826 does not move from the first operating position toward the second operating position until a threshold amount of force is applied to the baffle 832 or sleeve 826. Such a configuration allows an operator at a surface of the well to control when the sleeve 826 is moved from the first operating position to the second operating position. The application of such a threshold force to the baffle 832 or sleeve 826 is capable of moving the piston 848 within the chamber 851 such that the metering fluid 855 is expelled from the metering orifice 853. As the sleeve 826 moves into the second operating position, the port 816 is again blocked by the sleeve 826. A shoulder 849 disposed on the body 814 of the ball-activated fluid control system 810 may engage the piston 848 to stop the sleeve 826 in the second operating position.

The ball-activated fluid control system 810 further includes a ball 834 (see FIGS. 9 and 10) configured to engage the sleeve 826. The ball 834 has a diameter larger than the diameter of the passage 831 passing through the baffle 832, and thus the ball 834 is capable of obstructing fluid flow through the passage 831.

In operation, the ball-activated fluid control system 810 is run into the well with the sleeve 826 positioned in the home position. Prior to metering, the internal sleeve is held in the home position by shear pins or screws. The ball 834 may be dropped into the well by an operator when it is desired to shift the sleeve 826. The ball 834 is capable of traveling with fluid through the tubing string 120 (FIG. 1) until the ball 834 lands at the baffle 832. Since the diameter of the ball 834 is greater than the diameter of the passage 831, the ball 834 engages the seat 836 of the baffle 832 and blocks fluid flow through the passage 831. The operator is then capable of increasing fluid pressure uphole of the ball 834 to increase the force that is applied to the baffle 832 or sleeve 826. When the fluid uphole of the ball 834 reaches a first pressure, the sleeve 826 is capable of moving into the first operating position. When the sleeve 826 is positioned in the first operating position, the port 816 is opened such that fluid communication between the interior 818 and the exterior 822 is allowed. At this time, the geologic formation 115 may be fractured with fluids pumped through the tubing string 120 and into the geologic formation 115. When the geologic formation 115 has been fractured, the sleeve 826 may then be moved to the second operating position to close the port 816 by increasing the pressure of fluid uphole of the sleeve 826 to a second pressure that is more than the first pressure. When the fluid uphole of the sleeve 826 reaches the second pressure, the force on the baffle 832 is enough to overcome the resistance from the metering orifice 853, which allows metering fluid 855 to exit the chamber 851 and the piston 848 to move. This in turn allows the sleeve 826 to move to the second operating position shown in FIG. 10. The geologic formation 115 accessed by the port 816 is then isolated and frac fluids are held within the formation under pressure as the geologic formation 115 heals. Following the desired time for healing of the geologic formation 115, the port 816 may be re-opened by again moving the sleeve 826 or by milling the sleeve 826 to remove it from the body 814. In the open position the port 816 allows the frac fluids to exit the geologic formation 115 and regular production of oil or gas to begin. Preferably, proppants or other materials included with the frac fluid remain in place within the geologic formation 115 to assist in holding open fractures created by the frac process.

Figure 11:
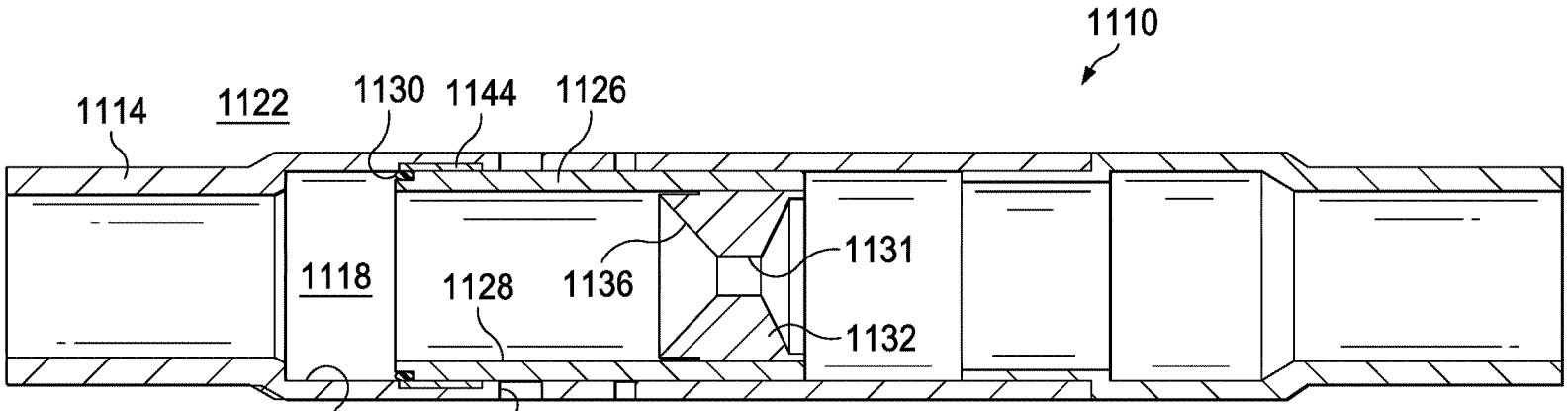
FIG. 11 illustrates a cross-sectional schematic view of a ball-activated fluid control apparatus in a home position according to an illustrative embodiment.
Figure 12:
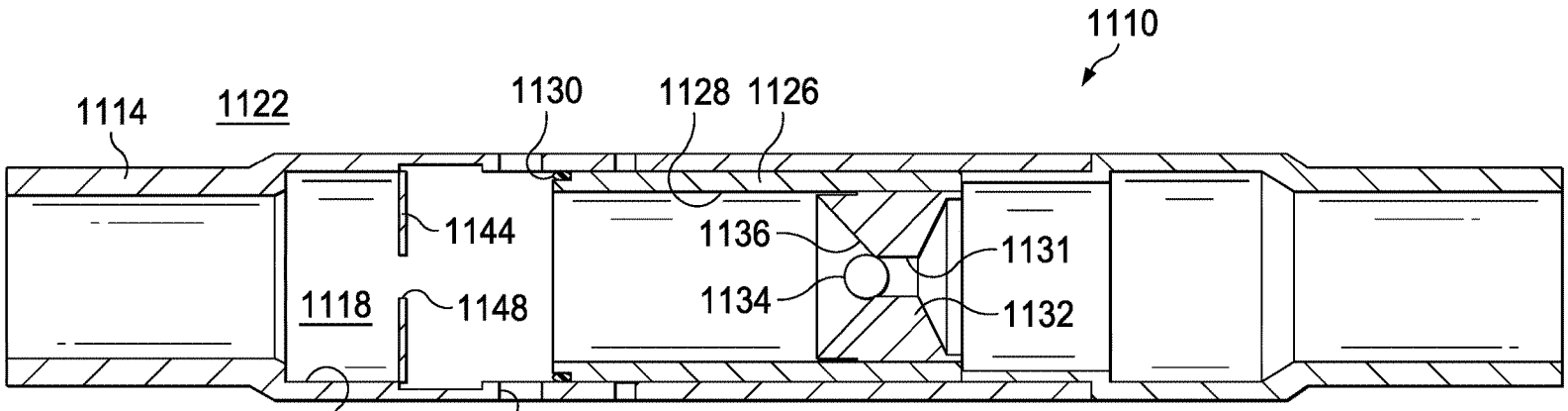
FIG. 12 illustrates a cross-sectional schematic view of the ball-activated fluid control apparatus of FIG. 11 in a first operating position.
Figure 13:
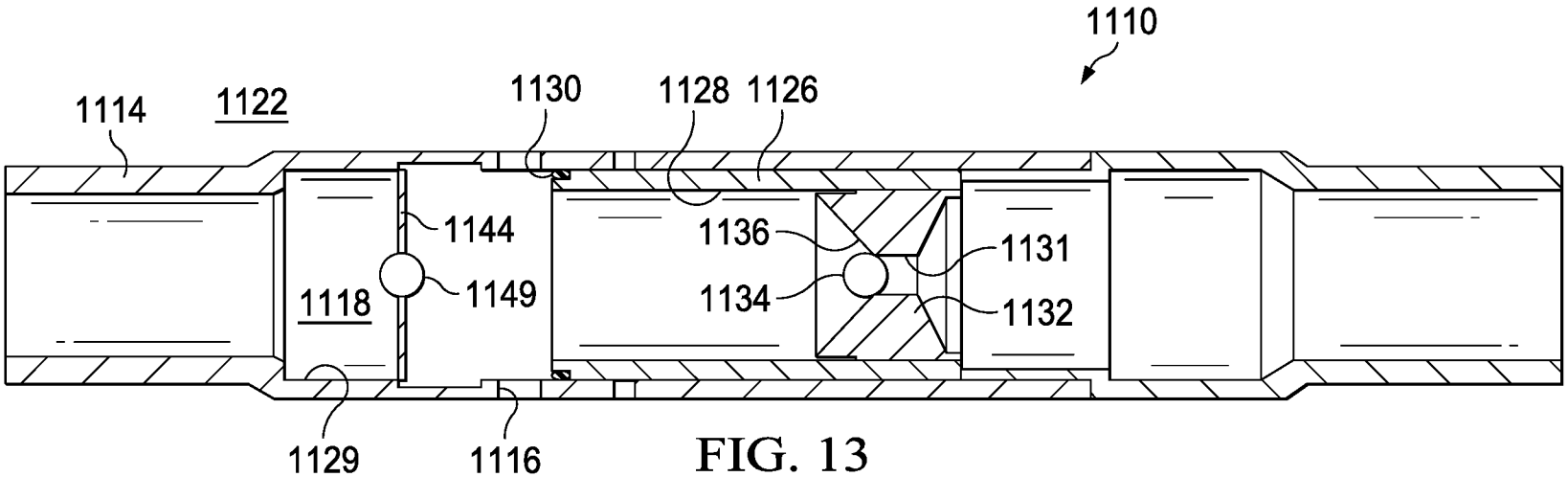
FIG. 13 illustrates a cross-sectional schematic view of the ball-activated fluid control apparatus of FIG. 11 in a second operating position.

Referring to FIGS. 11-13, a cross-sectional view of an embodiment of a ball-activated fluid control system 1110 is illustrated. The ball-activated fluid control system 1110 includes a body 1114 that may be coupled at each end to the tubing string 120 described with reference to FIG. 1. The ball-activated fluid control system 1110 is used in the same way as ball-activated fluid control system 110 (FIG. 1) to isolate well zones following fracturing of the geologic formation 115 adjacent a particular zone.

The body 1114 of the ball-activated fluid control system 1110 includes a port 1116 to provide fluid communication between an interior 1118 and an exterior 1122 of the body 1114. The port 1116 may be a circular hole or a non-circular aperture such as a slot. As shown in FIGS. 11-13, two or more ports 1116 may be provided to provide increased flow capacity between the interior 1118 and exterior 1122 when the ports 1116 are opened.

The ball-activated fluid control system 1110 further includes a sleeve 1126 slidingly disposed within the interior 1118 of the body 1114. The sleeve 1126 may include a body 1128 and a first baffle 1132 disposed within the body 1128. In some embodiments, the body 1114 is tubular and includes a central passage 1129 that has a larger diameter than a passage 1131 passing through the first baffle 1132. The first baffle 1132 may further include a seat 1136 upon which a sealing member such as a ball may be landed to block flow through the sleeve 1126. The first baffle 1132 may be an integral part of the sleeve 1126, or the first baffle 1132 may instead by coupled to the body 1128 of the sleeve 1126 by welding, press fitting, or other attachment means.

The sleeve 1126 is positionable within the body 1114 between a home position shown in FIG. 11 and a first operating position shown in FIGS. 12 and 13. In the home position, the sleeve 1126 prevents fluid communication between the interior 1118 and exterior 1122 through the port 1116. The sleeve 1126 may physically block the port 1116 to prevent such fluid communication. One or more seals 1130 may be coupled to either the body 1114 or the sleeve 1126 such that a sealed engagement occurs between the body 1114 and the sleeve 1126 when the sleeve 1126 is in the home position. The sealed engagement ensures isolation of the port 1116 such that fluid communication between the interior 1118 and the exterior 1122 is prevented. In the first operating position, the sleeve 1126 is positioned such that the port 1116 is open and fluid communication is capable of occurring between the interior 1118 and the exterior 1122. In the first operating position, the sleeve 1126 is positioned such that the port 1116 is open and fluid communication is capable of occurring between the interior 1118 and the exterior 1122. In the embodiment illustrated in FIG. 12, the port 1116 is opened since the sleeve 1126 has traveled further downhole and the sleeve 1126 no longer obstructs the port 1116. Alternatively, the sleeve 1126 could instead have an aperture, hole or other passage (not shown) through a wall of the sleeve 1126 that could align with the port 1116 when the sleeve 1126 is positioned in the first operating position. Again, this first operating position allows fluid communication between the interior 1118 and exterior 1122 through the port 1116.

The ball-activated fluid control system 1110 further includes a second baffle 1144 that is pivotally attached to the body 1114 of the ball-activated fluid control system 1110. The second baffle 1144 is movable between stored position shown in FIG. 11 and a deployed position shown in FIGS. 12 and 13. When the sleeve 1126 is in the home position, the second baffle 1144 is in the stored position and is held in the stored position by the body 1128 of the sleeve 1126. The body 1128 of the sleeve 1126 prevents deployment of the second baffle 1144.

The second baffle 1144 includes a biasing member (not shown) such as a spring or other element that biases the second baffle 1144 toward the deployed position. When the sleeve 1126 is placed in the first operating position, the biasing member causes the second baffle 1144 to move to the deployed position. When deployed the second baffle 1144 defines an orifice or passage 1148. In some embodiments, the second baffle 1144 may be one or more plates that are pivotally and sealingly coupled to the body 1114 of the ball-activated fluid control system 1110. When deployed, the second baffle 1144 preferably directs all fluid flow through the passage 1148.

The ball-activated fluid control system 1110 further includes a first ball 1134 (see FIGS. 12 and 13) configured to engage the first baffle 1132 and a second ball 1149 configured to engage the second baffle 1144 (see FIG. 13). The first ball 1134 has a diameter larger than the diameter of the passage 1131 of the first baffle 1132, and thus the first ball 1134 is capable of obstructing fluid flow through the passage 1131. The second ball 1149 has a diameter larger than the width or diameter of the passage 1148. The second ball 1149 is therefore capable of obstructing fluid flow through the passage 1148 when the second ball 1149 engages the second baffle 1144.

In operation, the ball-activated fluid control system 1110 is run into the well with the sleeve 1126 positioned in the home position. The internal sleeve is held in the home position by shear pins or screws. The first ball 1134 may be dropped into the well by an operator when it is desired to shift the sleeve 1126. The first ball 1134 is capable of traveling with fluid through the tubing string 120 (FIG. 1) until the first ball 1134 lands at the first baffle 1132. Since the diameter of the first ball 1134 is greater than the diameter of the passage 1131, the first ball 1134 engages the seat 1136 of the first baffle 1132 and blocks fluid flow through the passage 1131. The operator is then capable of increasing fluid pressure uphole of the first ball 1134 to increase the force that is applied to the first baffle 1132 or sleeve 1126. When the fluid uphole of the first ball 1134 reaches a first pressure, the sleeve 1126 is capable of moving into the first operating position. When the sleeve 1126 is positioned in the first operating position, the port 1116 is opened such that fluid communication between the interior 1118 and the exterior 1122 is allowed. The second baffle 1144 also moves into the deployed position when the sleeve 1126 moves from the home position to the first operating position.

With the port 1116 open, the geologic formation 115 may be fractured with fluids pumped through the tubing string 120 and into the geologic formation 115. When the geologic formation 115 has been fractured, the port 1116 may be isolated by pumping the second ball 1149 downhole to block the passage 1148 of the second baffle 1144. By isolating the port 1116 following injection of frac fluids into the geologic formation 115, the frac fluids may be held within the formation under pressure as the geologic formation 115 heals. Following the desired time for healing of the geologic formation 115, the passage 1148 may be re-opened by re-opening the second baffle 1144 or by milling the second baffle 1144 to remove it from the body 1114. In the open position the port 1116 and passage 1148 allow the frac fluids to exit the geologic formation 115 and regular production of oil or gas to begin. Preferably, proppants or other materials included with the frac fluid remain in place within the geologic formation 115 to assist in holding open fractures created by the frac process.

Each of the ball-activated fluid control systems described herein and those illustrated in FIGS. 2-13 may be deployed in a multi-zone frac system such as that illustrated in FIG. 1. When multiple sleeves are deployed downhole, the zones will generally be fractured and isolated in a toe-to-heel direction. The deployment of balls downhole to shift sleeves in each zone may be accomplished by sizing each ball to pass through the baffles of sleeves uphole of the targeted sleeve and zone. The sizing of a particular ball may be large enough to block flow through the baffle of the targeted sleeve as described herein.

The healing process permitted by the ball-activated fluid control systems described herein leads to more productive zones and requires less flowback for cleanup of sand or other proppants. The closing of the sleeves also provide the ability to build pressure in the well such as in the tubing string 120 or other tubulars to test casing pressure or perform other integrity tests. The elevated pressures can also be used to activate downhole tools or other mechanisms such as burst ports to allow for additional frac zones and more complex frac geometries. In combination with multi-entry (ME) sleeves, the ability to close sleeves provides a direct flow path into new zones without having to design limited-entry style frac systems. Closing sleeves may also allow numerous zones to be stimulated using fewer balls, which increases the total stage count possible compared to conventional sleeves.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a method of fracturing a subterranean formation comprising establishing a plurality of zones in a wellbore; fracturing and then isolating a first of the zones using a ball-activated sleeve such that proppant flow from the formation into the first zone is reduced; and fracturing and then isolating at least one other of the zones uphole of the first zone.

Clause 2, the method of clause 1, wherein isolating the first of the zones further comprises dropping a ball to close the ball-activated sleeve.

Clause 3, the method of clause 1, wherein isolating the first of the zones further comprises dropping a ball through a tubing string coupled to the ball-activated sleeve such that the ball contacts the sleeve; and increasing fluid pressure to a first pressure to exert a force on the ball-activated sleeve by the ball such that the ball-activated sleeve is moved to a closed position.

Clause 4, the method of clause 3 further comprising changing the fluid pressure to a second pressure to move the ball-activated sleeve to an open position thereby resulting in the first zone no longer being isolated.

Clause 5, the method of clause 4, wherein changing the fluid pressure further comprises increasing the fluid pressure.

Clause 6, the method of clause 1, wherein the fracturing of zones occurs in a toe-to-heel direction.

Clause 7, the method of clause 1, wherein each zone of the plurality of zones is fractured and then isolated sequentially in a toe-to-heel direction.

Clause 8, the method of clause 1, wherein the ball-activated sleeve is positioned within the first zone.

Clause 9, the method of clause 1, wherein a separate ball-activated sleeve is positioned in each of the zones to be isolated.

Clause 10, the method of clause 1 further comprising following a predetermined time, opening the ball-activated sleeve to allow production of formation fluids through the first zone.

Clause 11, the method of clause 1 wherein isolating the first of the zones further comprises dropping a first ball to close the ball-activated sleeve; and isolating the at least one other of the zones further comprises dropping a second ball to close a second ball-activated sleeve.

Clause 12, the method of clause 1, wherein isolating the first of the zones further comprises dropping a first ball through a tubing string coupled to the ball-activated sleeve such that the ball contacts the ball-activated sleeve; increasing fluid pressure within the tubing string to exert a force on the ball-activated sleeve by the first ball such that the ball-activated sleeve is closed; isolating the at least one other of the zones further comprises dropping a second ball through the tubing string coupled to a second ball-activated sleeve such that the second ball contacts the second ball-activated sleeve; and increasing fluid pressure within the tubing string to exert a force on the second ball-activated sleeve by the second ball such that the ball-activated sleeve is closed.

Clause 13, the method of clause 12 further comprising changing the fluid pressure to open at least one of the first and second ball-activated sleeves thereby resulting in the first or other zone no longer being isolated.

Clause 14, the method of clause 12, wherein the first ball passes through the second ball-activated sleeve as the ball travels to the first ball-activated sleeve.

Clause 15, the method of clause 14, wherein the first ball is smaller in diameter than the second ball.

Clause 16, a ball-activated fluid control apparatus positionable in a well during fracturing operations, the apparatus comprising a body configured to be coupled to a tubing string, the body having a port to provide fluid communication between an interior and exterior of the body; a sleeve slidingly disposed in the body and positionable between a home position in which the sleeve prevents fluid communication through the port, a first operating position in which the sleeve allows fluid communication through the port, and a second operating position in which the sleeve prevents fluid communication through the port; and a ball configured to engage the sleeve such that fluid exerting a first pressure on the ball moves the sleeve from the home position to the first operating position, and a fluid exerting a second pressure on the ball moves the sleeve from the first operating position to the second operating position.

Clause 17, the apparatus of clause 16, wherein the first pressure is less than the second pressure.

Clause 18, the apparatus of clause 16, wherein the sleeve is positioned in the home position as the apparatus is run in hole.

Clause 19, the apparatus of clause 16, wherein the sleeve is positioned in the first operating position during fracturing of a formation.

Clause 20, the apparatus of clause 16, wherein the sleeve is positioned in the second operating position following fracturing of the formation to maintain pressure at the formation and reduce flow of proppant from the formation.

Clause 21, the apparatus of clause 16 further comprising a retention system that prevents movement from the first operating position to the second operating position until application of the second pressure on the ball.

Clause 22, the apparatus of clause 16, wherein the body further comprises a metering chamber having a metering fluid and a nozzle, the nozzle configured to regulate flow of metering fluid out of the metering chamber through the nozzle; and the sleeve further comprises an aperture through the sleeve and configured for alignment with the port when the sleeve is in the first operating position; and a baffle having a passage configured to allow fluid flow through the sleeve, the passage having a diameter smaller than a diameter of the ball.

Clause 23, the apparatus of clause 21, wherein the first pressure moves the sleeve to the first operating position and the metering chamber prevents further movement of the sleeve; and the second pressure exerts additional force on the sleeve which causes metering fluid to exit the nozzle such that the sleeve moves to the second operating position.

Clause 24, the apparatus of clause 16, further comprising a shear member associated with the body, the shear member configured to stop movement of the sleeve at the first operating position when the first pressure is applied to the ball, the shear member configured to shear and allow movement of the sleeve from the first operating position to the second operating position when the second pressure is applied to the ball; and the sleeve further comprises an aperture through the sleeve and configured for alignment with the port when the sleeve is in the first operating position; and a baffle having a passage configured to allow fluid flow through the sleeve, the passage having a diameter smaller than a diameter of the ball.

Clause 25, a ball-activated fluid control apparatus positionable in a well during fracturing operations, the apparatus comprising a body configured to be coupled to a tubing string, the body having a port to provide fluid communication between an interior and exterior of the body; a sleeve slidingly disposed in the body and positionable between a home position in which the sleeve prevents fluid communication through the port and a first operating position in which the sleeve allows fluid communication through the port; a ball configured to engage the sleeve such that fluid exerting a first pressure on the ball moves the sleeve from the home position to the first operating position; and a spring associated with the body and the sleeve such that the sleeve is biased to the home position, the spring configured to prevent movement of the sleeve from the home position to the first operating position until the first pressure is applied to the ball.

Clause 26, the apparatus of clause 25, wherein the sleeve further comprises an aperture through the sleeve and configured for alignment with the port when the sleeve is in the first operating position; and a baffle having a passage configured to allow fluid flow through the sleeve, the passage having a diameter smaller than a diameter of the ball.

Clause 27, the apparatus of clause 25, wherein the spring returns the sleeve to the home position when the pressure is less than the first pressure.

Clause 28, a ball-activated fluid control apparatus positionable in a well during fracturing operations, the apparatus comprising a body configured to be coupled to a tubing string, the body having a port to provide fluid communication between an interior and exterior of the body; a sleeve slidingly disposed in the body and positionable between a home position in which the sleeve prevents fluid communication through the port and a first operating position in which the sleeve allows fluid communication through the port; a ball configured to engage the sleeve such that fluid exerting a first pressure on the ball moves the sleeve from the home position to the first operating position; a baffle pivotally coupled to the body and movable between a stored position and a deployed position, the baffle positioned in the stored position when the sleeve is positioned in the home position, the baffle positioned in the deployed position when the sleeve is positioned in the first operating position; and a second ball configured to engage the baffle when the baffle is in the deployed position such that fluid flow through the aperture is prevented.

While this specification provides specific details related to certain components of a system and method for fracturing a subterranean formation, it may be appreciated that the list of components is illustrative only and is not intended to be exhaustive or limited to the forms disclosed. Other components related to downhole fracturing systems and shiftable sleeves within a wellbore will be apparent to those of ordinary skill in the art without departing from the scope and spirit of the disclosure. Further, the scope of the claims is intended to broadly cover the disclosed components and any such components that are apparent to those of ordinary skill in the art.

I claim:

1. A method of fracturing a subterranean formation comprising:

establishing a plurality of zones in a wellbore;

fracturing and then isolating a first of the zones using a ball-activated sleeve such that proppant flow from the formation into the first zone is reduced;

fracturing and then isolating at least one other of the zones uphole of the first zone increasing fluid pressure to a first pressure to exert a force on the ball-activated sleeve by the ball such that the ball-activated sleeve is moved to a closed position; and changing the fluid pressure to a second pressure to move the ball-activated sleeve to an open position thereby resulting in the first zone no longer being isolated.

2. The method of claim 1, wherein isolating the first of the zones further comprises:

dropping a ball to close the ball-activated sleeve.

3. The method of claim 1, wherein isolating the first of the zones further comprises:

dropping a ball through a tubing string coupled to the ball-activated sleeve such that the ball contacts the sleeve.

4. The method of claim 1, wherein changing the fluid pressure further comprises:

increasing the fluid pressure.

5. The method of claim 1, wherein the fracturing of zones occurs in a toe-to-heel direction.

6. The method of claim 1, wherein each zone of the plurality of zones is fractured and then isolated sequentially in a toe-to-heel direction.

7. The method of claim 1, wherein the ball-activated sleeve is positioned within the first zone.

8. The method of claim 1, wherein a separate ball-activated sleeve is positioned in each of the zones to be isolated.

9. The method of claim 1 further comprising:

following a predetermined time, opening the ball-activated sleeve to allow production of formation fluids through the first zone.

10. The method of claim 1 wherein:

isolating the first of the zones further comprises dropping a first ball to close the ball-activated sleeve; and isolating the at least one other of the zones further comprises dropping a second ball to close a second ball-activated sleeve.

11. The method of claim 1, wherein:

isolating the first of the zones further comprises:

dropping a first ball through a tubing string coupled to the ball-activated sleeve such that the ball contacts the ball-activated sleeve;

increasing fluid pressure within the tubing string to exert a force on the ball-activated sleeve by the first ball such that the ball-activated sleeve is closed;

isolating the at least one other of the zones further comprises:

dropping a second ball through the tubing string coupled to a second ball-activated sleeve such that the second ball contacts the second ball-activated sleeve; and increasing fluid pressure within the tubing string to exert a force on the second ball-activated sleeve by the second ball such that the ball-activated sleeve is closed.

12. The method of claim 11 further comprising:

changing the fluid pressure to open at least one of the first and second ball-activated sleeves thereby resulting in the first or other zone no longer being isolated.

13. The method of claim 11, wherein:

the first ball passes through the second ball-activated sleeve as the ball travels to the first ball-activated sleeve.

14. The method of claim 13, wherein the first ball is smaller in diameter than the second ball.

15. A ball-activated fluid control apparatus positionable in a well during fracturing operations, the apparatus comprising:

a body configured to be coupled to a tubing string, the body having a port to provide fluid communication between an interior and exterior of the body;

a sleeve slidingly disposed in the body and positionable between a home position in which the sleeve prevents fluid communication through the port, a first operating position in which the sleeve allows fluid communication through the port, and a second operating position in which the sleeve prevents fluid communication through the port; and a ball configured to engage the sleeve such that fluid exerting a first pressure on the ball moves the sleeve from the home position to the first operating position, and a fluid exerting a second pressure on the ball moves the sleeve from the first operating position to the second operating position.

16. The apparatus of claim 15, wherein the first pressure is less than the second pressure.

17. The apparatus of claim 15, wherein the sleeve is positioned in the home position as the apparatus is run in hole.

18. The apparatus of claim 15, wherein the sleeve is positioned in the first operating position during fracturing of a formation.

19. The apparatus of claim 15, wherein the sleeve is positioned in the second operating position following fracturing of the formation to maintain pressure at the formation and reduce flow of proppant from the formation.

20. The apparatus of claim 15 further comprising a retention system that prevents movement from the first operating position to the second operating position until application of the second pressure on the ball.

21. The apparatus of claim 20, wherein:

the first pressure moves the sleeve to the first operating position and the metering chamber prevents further movement of the sleeve; and the second pressure exerts additional force on the sleeve which causes metering fluid to exit the nozzle such that the sleeve moves to the second operating position.

22. The apparatus of claim 15, wherein:

the body further comprises a metering chamber having a metering fluid and a nozzle, the nozzle configured to regulate flow of metering fluid out of the metering chamber through the nozzle; and the sleeve further comprises:

an aperture through the sleeve and configured for alignment with the port when the sleeve is in the first operating position; and a baffle having a passage configured to allow fluid flow through the sleeve, the passage having a diameter smaller than a diameter of the ball.

23. The apparatus of claim 15, further comprising:

a shear member associated with the body, the shear member configured to stop movement of the sleeve at the first operating position when the first pressure is applied to the ball, the shear member configured to shear and allow movement of the sleeve from the first operating position to the second operating position when the second pressure is applied to the ball; and the sleeve further comprises:

an aperture through the sleeve and configured for alignment with the port when the sleeve is in the first operating position; and a baffle having a passage configured to allow fluid flow through the sleeve, the passage having a diameter smaller than a diameter of the ball.

24. A ball-activated fluid control apparatus positionable in a well during fracturing operations, the apparatus comprising:

a body configured to be coupled to a tubing string, the body having a port to provide fluid communication between an interior and exterior of the body;

a sleeve slidingly disposed in the body and positionable between a home position in which the sleeve prevents fluid communication through the port and a first operating position in which the sleeve allows fluid communication through the port and a second operating position in which the sleeve prevents fluid communication through the port;

a ball configured to engage the sleeve such that fluid exerting a first pressure on the ball moves the sleeve from the home position to the first operating position; and a spring associated with the body and the sleeve such that the sleeve is biased to the home position, the spring configured to prevent movement of the sleeve from the home position to the first operating position until the first pressure is applied to the ball and configured to prevent movement of the sleeve from the first operating position to the second operating position until the second pressure is applied to the ball.

25. The apparatus of claim 24, wherein the sleeve further comprises:

an aperture through the sleeve and configured for alignment with the port when the sleeve is in the first operating position; and a baffle having a passage configured to allow fluid flow through the sleeve, the passage having a diameter smaller than a diameter of the ball.

26. The apparatus of claim 24, wherein the spring returns the sleeve to the home position when the pressure is less than the first pressure.

27. A ball-activated fluid control apparatus positionable in a well during fracturing operations, the apparatus comprising:

a body configured to be coupled to a tubing string, the body having a port to provide fluid communication between an interior and exterior of the body;

a sleeve slidingly disposed in the body and positionable between a home position in which the sleeve prevents fluid communication through the port and a first operating position in which the sleeve allows fluid communication through the port;

a ball configured to engage the sleeve such that fluid exerting a first pressure on the ball moves the sleeve from the home position to the first operating position;

a baffle pivotally coupled to the body and movable between a stored position and a deployed position, the baffle positioned in the stored position when the sleeve is positioned in the home position, the baffle positioned in the deployed position when the sleeve is positioned in the first operating position; and a second ball configured to land on the baffle to engage the baffle when the baffle is in the deployed position such that fluid flow through an aperture through the sleeve is prevented.

* * * * *